US009302315B2

(12) United States Patent
Verbeek et al.

(10) Patent No.: US 9,302,315 B2
(45) Date of Patent: Apr. 5, 2016

(54) DEVICE FOR FORMING DEEP-DRAWN CONTAINERS

(75) Inventors: Dick Cornelis Verbeek, Apeldoorn (NL); Harry Johan Kettelarij, Lochern (NL)

(73) Assignee: Amcor Flexibles Kreuzlingen Ltd., Kreuzlingen (CH)

( * ) Notice: Subject to any disclaimer, the term of this patent is extended or adjusted under 35 U.S.C. 154(b) by 819 days.

(21) Appl. No.: 13/386,684

(22) PCT Filed: Jul. 6, 2010

(86) PCT No.: PCT/EP2010/004020
§ 371 (c)(1),
(2), (4) Date: Jan. 24, 2012

(87) PCT Pub. No.: WO2011/012196
PCT Pub. Date: Feb. 3, 2011

(65) Prior Publication Data

US 2012/0119418 A1 May 17, 2012

(30) Foreign Application Priority Data

Jul. 30, 2009 (DE) ..... 10 2009 035 680

(51) Int. Cl.
*B21D 51/26* (2006.01)
*B21D 22/26* (2006.01)

(52) U.S. Cl.
CPC ..... *B21D 51/2646* (2013.01); *B21D 22/26* (2013.01)

(58) Field of Classification Search
CPC ..... B21D 22/20; B21D 22/22; B21D 22/28; B21D 28/28; B21D 22/10; B21D 22/105; B21D 22/26; B21D 28/18; B21D 51/26; B21D 51/2646; B29C 51/085
USPC ..... 72/347, 348, 470, 475, 466.8, 413, 72/465.1, 57, 465, 45.1
See application file for complete search history.

(56) References Cited

U.S. PATENT DOCUMENTS 2,966,873 A * 1/1961 Hoffman et al. ..... 72/57
4,193,285 A 3/1980 Zumsteg
4,365,498 A * 12/1982 Hirota et al. ..... 72/351
4,483,171 A 11/1984 Franek
4,562,717 A * 1/1986 Shimizu et al. ..... 72/347

(Continued)

FOREIGN PATENT DOCUMENTS

EP 0530956 A1 3/1993

OTHER PUBLICATIONS

International Application Serial No. PCT/EP2010/004020, International Search Report mailed Dec. 28, 2010, 2 pgs.

*Primary Examiner* — Debra Sullivan
(74) *Attorney, Agent, or Firm* — RatnerPrestia

(57) ABSTRACT

The invention relates to a device for forming deep-drawn containers, with a mold, which has a conical shape and interacts with a stamping body, which operatively connects with a material web when the stamping body enters the mold, the stamping body containing a resilient material, at least at its outer periphery, and the stamping body having a shape on the side facing the material web, the conicity of which is less than the conicity of the mold. According to the invention it is provided that the stamping body has a slightly smaller size than the opening region of the mold, and in that when the stamping body is completely located in the mold, said stamping body has a clearance with respect to the material web, at least in the later edge region of the container.

19 Claims, 2 Drawing Sheets

(56) References Cited

U.S. PATENT DOCUMENTS 4,926,673 A * 5/1990 Laurent et al. ..... 72/466.8
5,000,029 A * 3/1991 Laurent et al. ..... 72/466.8
5,048,317 A * 9/1991 Hirota ..... B21D 51/2646 72/347
5,205,146 A * 4/1993 Wilkins ..... B21D 22/26 72/54
5,213,739 A * 5/1993 Dickerson et al. ..... 264/135
6,029,486 A * 2/2000 Haraga et al. ..... 72/57
6,260,394 B1 * 7/2001 Haraga ..... B21D 22/10 72/57

* cited by examiner

DEVICE FOR FORMING DEEP-DRAWN CONTAINERS

CROSS-REFERENCE TO RELATED APPLICATIONS

This is a U.S. National Phase application of International application number PCT/EP2010/004020, filed Jul. 6, 2010, which claims priority benefit of German Application number 10 2009 035 680.0, filed Jul. 30, 2009, both of which are incorporated herein by reference in their entirety for all purposes.

BACKGROUND OF THE INVENTION

The invention relates to a device for forming deep-drawn containers according to the preamble of claim 1.

A device of this type is known from U.S. Pat. No. 4,562,717. In the known device, a stamping body consisting of a resilient material is used to avoid irregularities in the cup wall, in particular folds. The stamping body, which interacts with a conically configured mould, which determines the external shape of the cup, has a slope here of between 0 degrees and 20 degrees. Furthermore, the stamping body has a centrally arranged recess, the shape of which is truncated cone-shaped, a cylindrically shaped receiving pin additionally being arranged in the recess. During the deep drawing of the container, the clearance between the cylindrically shaped pin and the stamping body is completely filled by a deformation of the stamping body in the end position of the stamping body, in which the stamping body has completely entered the mould. Furthermore, at its outer periphery, the stamping body rests completely on the material web in the region of the mould.

It has been found that, with a device configured in this manner, the irregularities or folds mentioned in the wall of the container are indeed avoided, but the stackability of the containers is relatively poor. Good stackability of the containers is here taken to mean the property that containers which are inserted in one another abut as completely as possible on the container edge thereof, so that at a specific stack height, as many containers as possible can be stacked in one another and the stack at the same time has a vertical orientation as far as possible. If this is not the case, both during the processing of the containers in a packaging machine that fills the containers and closes them, and also during the handling of the containers, in particular when separating individual containers from a container stack in a storage magazine, an increased outlay becomes necessary.

Proceeding from the prior art described, the invention is based on the object of developing a device for forming deep-drawn containers according to the preamble of claim 1 in such a way that their stackability is improved. This object is achieved in a device for forming deep-drawn containers by the features of claim 1.

SUMMARY OF THE INVENTION

The invention is based on the idea, in this case, that a clearance is formed in the end position of the stamping body, in which the latter is in its lowest position in the mould, between the stamping body and the container wall in the region of the opening region of the container. It has namely been found that when removing the stamping body from the mould or when demoulding the containers, the latter therefore have a very high, constant precision or conicity in the region of the opening of the container, which forms the region of the cup edge. As a result, the stackability of the containers is significantly increased or improved.

Advantageous developments of the device according to the invention for forming deep-drawn containers are given in the sub-claims. All combinations of at least two of the features disclosed in the description, the claims and/or the figures fall within the scope of the invention.

It is provided here in a preferred embodiment of the invention for the simple configuration of the clearance, that the stamping body has a region which is reduced with respect to its cross sectional area compared to the region of the stamping body firstly operatively connecting with the material web, and in that the region firstly operatively connecting with the material web has a height of at least 5 mm.

It is also preferred for the mould to have an angle of conicity of 1 degree to 20 degrees, in particular from 5 degrees to 12 degrees, and that the stamping body is cylindrical in the region forming the container wall or else has a conicity which is less than the conicity of the container wall, the angle of conicity of the region in particular being between 0 degrees and 8 degrees. Containers, which can easily be demoulded, are formed by this configuration.

It is particularly easy to produce the stamping body if the stamping body has at least two regions, of which one region is the region forming the container wall and the other region is the region in which the stamping body has the clearance with respect to the container wall.

Natural rubber, acrylonitrile-butadiene rubber or urethane rubber have proven to be preferred materials for producing the stamping bodies.

Furthermore, tests have shown that it is advantageous in the materials mentioned if the stamping body has a hardness of 50 ShA to 130 ShA, preferably from 70 ShA to 95 ShA.

The forming process can be facilitated if the material of the stamping body contains at least one additive, in particular an additive for improving the sliding property based on fluorine, such as, for example Teflon®.

In addition, it may be provided that the material of the stamping body contains a filler or a material for reinforcement, such as, for example, carbon black, silicon, clay or chalk.

To fix and guide the stamping body in the device, it may be provided that the stamping body is vulcanised on a carrier element consisting of metal.

To achieve high precision and dimensional stability of the containers, it is proposed in a further advantageous development that the stamping body is annular and interacts with an insert consisting of metal, which is connected to a carrier element consisting of metal. Owing to the insert, good centering of the material web and a longer service life of the stamping body can be achieved.

In particular, it may be advantageously provided here that an, in particular, annular clearance is configured between the insert and the stamping body.

In order to be able to form an embossed cup base, it is provided that the insert on the side opposing the carrier element is configured as an embossed plate with a structure (embossed edge), which forms the base region of the container.

BRIEF DESCRIPTION OF THE DRAWINGS

Further advantages, features and details of the invention emerge from the following description of preferred embodiments and with the aid of the drawings, in which.

DETAILED DESCRIPTION OF THE INVENTION

Figure 1:
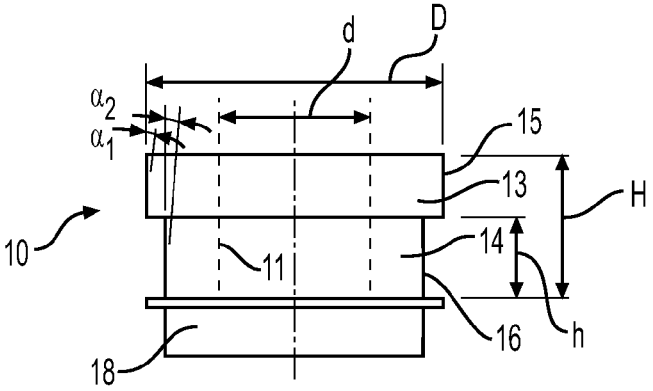
FIG. 1 shows a first stamping body for forming round containers with a carrier element without using an insert, in a side view.
Figure 9:
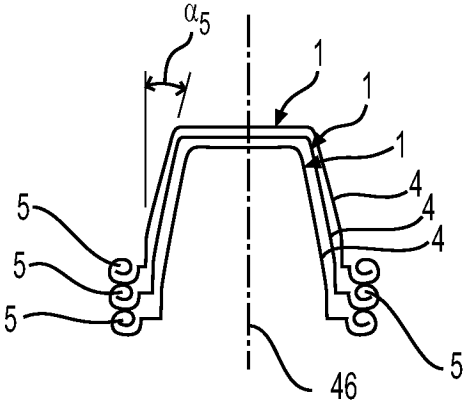
FIG. 9 shows a plurality of containers stacked inside one another, which have been produced using a device according to FIGS. 6 to 8, in longitudinal section.

FIG. 1 shows a first stamping body 10 for forming round containers 1 (see also FIG. 9). The rotationally symmetrical stamping body 10 may, for example, consist of natural rubber, an acrylonitrile-butadiene rubber or of a urethane rubber or at least contain these materials. Alternative stamping body materials are synthetic polyisoprene rubber, styrene-butadiene rubber, hydrogenated nitrile rubber, acrylic rubber, epichlorohydrin rubber, epichlorohydrin-ethylene-oxide rubber, chloroprene rubber, polybutadiene rubber, butyl rubber or ethylene-propylene-diene monomers.

The hardness of the stamping body 10 is here between 50 ShA and 130 ShA, preferably between 70 ShA and 95 ShA.

The materials of the stamping body 10 may contain activators and/or accelerators for a vulcanisation process mentioned later, flexibilisers or plasticisers, stabilisers, in particular against oxidisation and damage from ozone, processing aids, tackifiers and/or reinforcing agents or fillers. The stamping body 10 may contain as reinforcement agents or fillers, for example, carbon black, silicon oxide, aluminium oxide, chalk or lime. The stamping body 10 may be provided, at least on its surface which is effective for forming, or through the entire stamping body material, with lubricants, for example polymers containing fluoride, or polyhalogen olefins, such as polytetrafluorethylene (TEFLON®), α-boron nitride or graphite. Furthermore, dyes are also possible, which allow the stamping body 10 to appear in a desired colour, as desired or needed.

The stamping body 10 has a continuous bore 11 in its longitudinal axis. The diameter d of the bore 11 is approximately half the diameter D of the stamping body 10 ±15 mm here. The diameter D of the stamping body 10 corresponds to the internal diameter of the container 1 ±3 mm.

The stamping body 10 has two regions 13 and 14. The first region 13 has a larger diameter than the second region 14. The lateral surfaces 15, 16 of the regions 13, 14 are either cylindrical or have a small conicity, the angle α1 of the lateral surface 15 and the angle α2 of the lateral surface 16 in each case being able to be between 0 degrees and 8 degrees. The height h of the region 14 is between 0 mm and the total height H less 5 mm, a diameter in the region of the lateral surface 16 being able to be up to 20 mm less than a diameter D of the region 13.

The stamping body 10 described thus far may be vulcanised on a carrier element or a carrier plate 18. This may take place by means of a solvent-based two-component or single-component system or by means of a water-soluble binding system. Vulcanised stamping bodies 10 may be vulcanised by sulphur or peroxide treatment. The carrier plate 18 may be made of, for example, nitrided or case-hardened or case-hardened nitrided steel. The carrier plate 18 consisting of metal here has an approximate diameter which corresponds to the external diameter of the stamping body 10.

Figure 2:
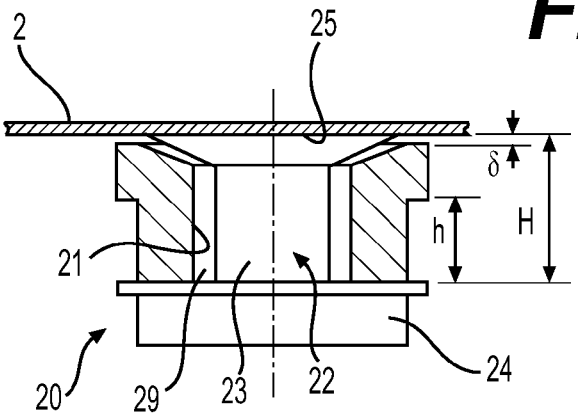
FIG. 2 shows a second stamping body for forming round containers using an insert and a carrier element, in longitudinal section.
Figure 3:
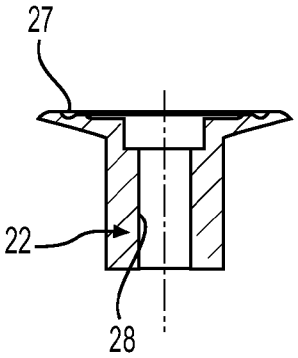
FIG. 3 shows the insert used in FIG. 2, in a longitudinal section.

FIG. 2 shows a second stamping body 20. The second stamping body 20 differs from the first stamping body 10 substantially by the use of a metallic insert body 22 which is arranged in the bore 21. The insert body 22 has a cylindrical region 23, which widens with respect to diameter on the side opposing the carrier plate 24. The upper side 25 of the insert body 22 may be configured here as an embossed plate, which, by way of example, has an elevated, radially peripheral embossed edge 27 (FIG. 3), which forms a corresponding recess in the base region of a container 1.

Configured in the longitudinal axis of the insert body 22 there is also a receiving bore 28, in which a screw, not shown, can be arranged, which screws or braces the insert body 22 onto the carrier plate 24 and may have a ventilation bore. The stamping body 20 is fastened to the carrier plate 24 by means of the insert body 22 screwed to the carrier plate 24, so a vulcanisation of the stamping body 20 can be dispensed with. The external diameter or the shape of the insert body 22 is such that an annular clearance 29 is configured between the external periphery of the insert body 22 and the internal periphery of the second stamping body 20.

Figure 4:
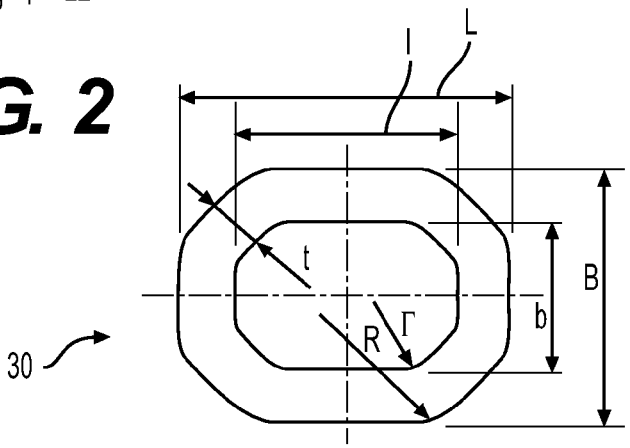
FIG. 4 shows a plan view of a third stamping body for forming containers, which have an approximately octagonal shape without using an insert.
Figure 5:
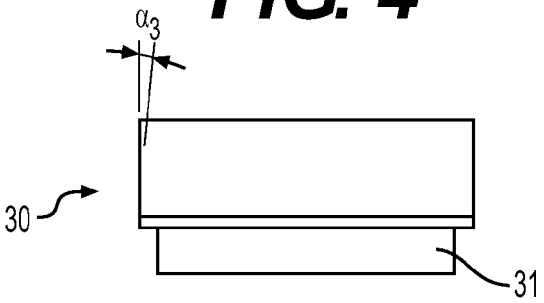
FIG. 5 shows a stamping body according to FIG. 4 in a side view with a carrier element.

FIGS. 4 and 5 show a third stamping body 30 for forming approximately octagonal containers. The length L here corresponds to the internal length of the container ±3 mm. The length l corresponds to the length L less twice the wall thickness t±5 mm. The width B corresponds to the internal width of the container ±3 mm. Furthermore, the internal width b corresponds to the width B less the double wall thickness t±5 mm. The external radius R is between 2 mm and 40 mm, while the internal radius r is approximately between 0.5 mm and 30 mm. The height H corresponds to the height of the containers. Here, too, the region of the stamping body 30 which is remote from the carrier plate 31 may be configured enlarged (not shown) compared to the region facing the carrier plate 31 in accordance with the two stamping bodies 10, 20. In accordance with the stamping body 20, the stamping body 30 can also be configured using an insert. Furthermore, the external shape of the stamping body 30 may either be cylindrical or have an angle α3 of conicity of 0 degrees up to about 8 degrees.

Figure 6:
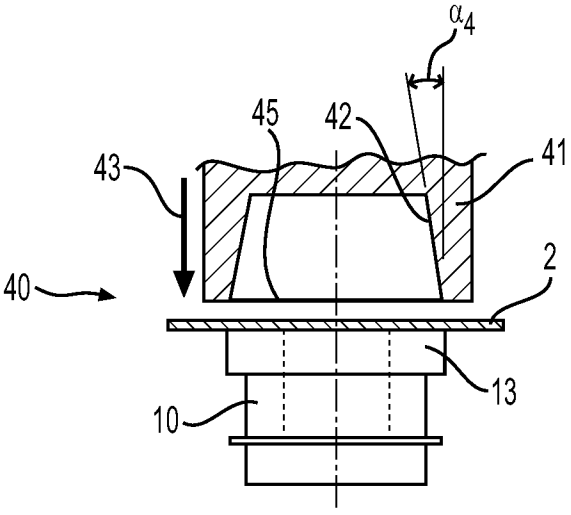
FIG. 6 to FIG. 8 show the production process for a container using the stamping body shown in FIG. 1 during various phases, in each case, in simplified longitudinal sections.
Figure 7:
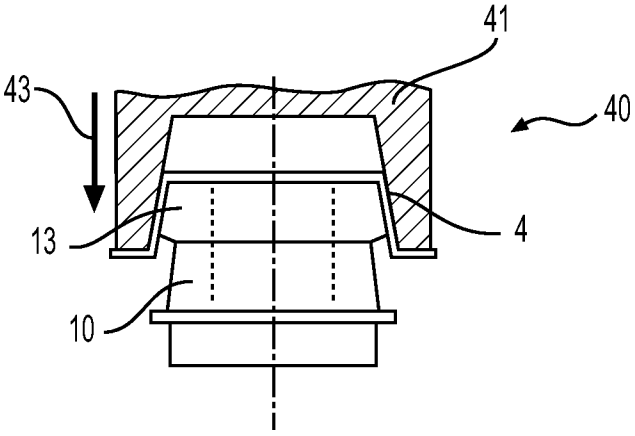
Figure 8:
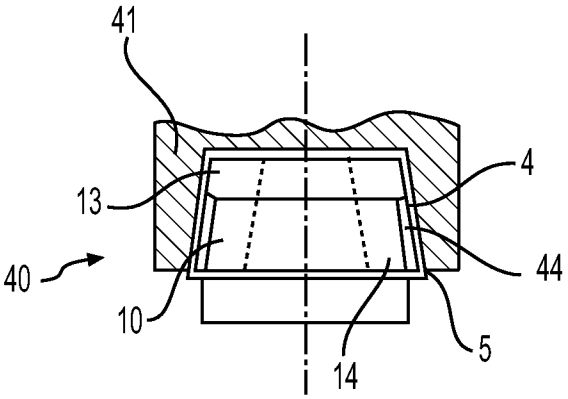

The manufacturing process of a container 1 from a material web pre-cut part which is separated immediately beforehand from a material web 2, by means of a device 40, is now described in FIGS. 6 to 8.

The material webs 2 may, for example, contain an aluminium substrate. In particular, the aluminium substrate is at least one aluminium foil, which is coated by lamination and/or extrusion, such as by a co-extrusion, with, for example, plastics materials or by varnishes. Typical material webs may have one of the following two layer structures, containing the layers:

sealing layer/aluminium foil/varnish or sealing layer/aluminium foil/core layer/aluminium foil/varnish Typical sealing layers are, for example, polypropylene sealing layers in a thickness of 20 μm to 200 μm or sealing layers made of polyethylene in a thickness of 20 μm to 200 μm. The sealing layers may undergo a separation-resistant connection with the sealing or may form a peelable layer and the sealing layers may, from case to case, absorb pressure and impact forces. The core layer may, for example, be a polypropylene or polyethylene, for example in the form of a film with a thickness of 20 μm to 200 μm. The aluminium foil may have a thickness of 20 μm to 200 μm, particularly preferably between 80 μm and 160 μm and, in this case, in particular be a soft alloy, semi-hard alloy or three quarters-hard alloy. The varnishes used may, for example, be varnishes which are known per se, such as acrylic varnishes, PVC varnishes, cellulose varnishes, stoving varnishes, epoxy-containing varnishes, nitro varnishes, etc.

Further material webs which can be used have, for example, one of the following layer construction types:

PP/aluminium/foam/aluminium
PP/aluminium/PP-foam-PP/aluminium
PP/aluminium/PP-foam-PP
PP/aluminium/PP-foam
PP/aluminium/foam The layer designated PP is, in particular, a polypropylene sealing layer directed toward the inside of a container. An alternative possibility is a sealing layer, directed toward the inside of a container, made of polyethylene. In a further embodiment, a PP or PE layer which is located completely on the inside and a polyethylene or polypropylene adhesive layer resting thereon may be provided. The adhesive layer made of polypropylene, or polyethylene, may have a thickness of 10 μm to 60 μm. The sealing layers may, for example, have a total thickness of 20 μm to 200 μm.

The foam material may be a closed-cell plastics material foam, for example made of a polyolefin, such as polypropylene (PP foam), or a polyethylene terephthalate foam (PET), used as a C-PET or A-PET. The material pairing PP-foam-PP indicates a multi-layer composite made of two cover layers or cover films, for example with a thickness of 12 μm to 200 μm, made of polypropylene and a foam layer arranged in between made of, for example, polypropylene or polyethylene terephthalate. The foam layers may have a thickness of 500 μm to 2000 μm.

The aluminium has a thickness of advantageously 20 μm to 200 μm, preferably 80 μm to 160 μm, and is, for example, a soft, semi-hard or three quarters-hard alloy.

Further usable material webs contain:

PP/aluminium/PP or oPA (oriented polyamide)
or
PP/substrate/varnish

PP indicates a polypropylene sealing layer, PE a polyethylene sealing layer, the sealing layer being able to be designed to be fully adhesive or peelable. In this case, layer thicknesses for the PP (polypropylene) of 20 μm to 80 μm are advantageous. The oriented polyamide may, in particular, be biaxially or monoaxially oriented and have a thickness of 10 μm to 50 μm. The aluminium has a thickness of advantageously 20 μm to 100 μm and is, for example, a soft, semi-hard or three quarters-hard alloy. The conventional commercial varnishes may in turn be used.

A further material web 2 being used may be produced by extrusion coating of steel (ECCS) coated electrolytically with chromium, with the exemplary structure:

sealing varnish/steel/decorative varnish.

The sealing layer may contain polypropylene, PVC, PET or epoxy or combinations thereof and may be used in quantities of 2 g/m$^2$ to 12 g/m$^2$. The steel may have a thickness of 130 μm to 170 μm and is advantageously soft and deeply quenched and tempered. The varnishes, including decorative varnishes, are conventional commercial varnishes, for example in various colour shades.

Containers, for example rotationally symmetrical containers in plan view, can be produced by means of the device 40 according to the invention from the material webs 2, with external diameters D of 12 to 150 mm and internal diameters $D_i$ of 55 to 155 mm. The side wall angle may be between 1 and 20 degrees. The height of a container (H) based on the deep-drawing ratio (β) can be shown as follows:

$$H_{max} \approx 0.5 \times D_i$$

It is also possible to produce containers with a non-symmetrical plan view by means of the device according to the invention. For example, containers which are oval or polygonal, such as rectangular or square, but also pentagonal, hexagonal, octagonal etc., in plan view, may be produced. Typical radii for corner regions are between 2 and 40 mm at the outer edge and 0.5 to 30 mm at the inner edge (internal radius r) of the side wall. The length of the side edges is not critical. The height of a non-rotationally symmetrical container, based on the deep-drawing ratio (β) is approximately:

$$H_{max} \approx 2.5 \times \text{internal radius } r$$

A rolled edge 5 (FIG. 5) with a diameter of about 1 to 2.5 mm can be provided on all the above-mentioned containers. The containers may have a sealing flange. The sealing flange, which will also be called a rolled edge 5 below, is expediently an endless sealing flange, and may, for example, be 2.5 to 5.0 mm in width. An angle α5 of the side wall may be between 1 and 20°.

The method with the present device allows a production speed of, for example 50 to 150 and in particular from 70 to 130 cycles/min. It has proven to be advantageous here if the material web 2 is provided with a layer of a suitable lubricant, for example oil or grease, during processing in the device 40. Layer quantities of 300 to 800 mg/m$^2$, in particular from 400 to 600 mg/m$^2$ have proven to be advantageous here.

The device 40 (FIGS. 6-8) has a mould 41, which determines the external shape of the container 1 and interacts, by way of example, with the stamping body 10. The inner wall 42 of the mould 41 has an angle α4 of conicity here of 1 degree to 20 degrees, in particular from 5 degrees to 12 degrees, which allows or improves the demoulding from the mould 41 and a stacking of containers 1 inside one another. Furthermore, the stamping body 10, on the side facing the mould 41, has a slightly smaller size than the mould 41 in the region of its opening cross section 45.

To deep-draw the containers 1, by way of example, the mould 41 of the device 40 is moved downwardly in the direction of the arrow 43 toward the stamping body 10, which is rigidly arranged and oriented with the mould 41 in the longitudinal axis thereof, the material web 2 being clamped in by means of clamping means, not shown, in a known manner. When the stamping body 10 enters the mould 41, the stamping body 10 is compressed both axially and radially, the material web 2 being pulled between the region 13 of the stamping body 10 and the internal wall 42, without there being a clearance between the region 13 of the stamping body 10 and the internal wall 42 and between the internal wall 42 and the mould 41. The side wall 4 of the container 1 is configured thereby.

As can be seen, in particular, with the aid of FIG. 8, in which the stamping body 10 has its end position in relation to the mould 41, a spacing or clearance 44 is configured between the side wall 4 and the region 14 of the stamping body 10. Here, this clearance 44 exists in particular in the region of the later lateral cup edge 5.

At the end of the deep-drawing process, the material web pre-cut part of the container 1 is formed in the region of its container edge, so that the rolled edge 5 is configured (FIG. 9).

As can best be seen with the aid of FIG. 9, it is important here for the side walls 4 of the container 1 to be able to be produced with very high geometrical precision or reproducibility owing to the special configuration of the stamping body 10. As a result, good stackability of the containers 1 can be made possible, i.e. with a plurality of containers 1 stacked inside one another, these are arranged symmetrically with respect to a longitudinal axis 46, with the rolled edges 5 of the containers 1 lying on one another, viewed over their total periphery.

The invention claimed is:

1. A device for forming a deep-drawn container, comprising a mould, which has a conical shape having a first angle of conicity and interacts with a stamping body, which operatively connects with a material web when the stamping body enters the mould, the stamping body comprising a resilient material, at least at an outer periphery of the stamping body and a lateral surface having a second angle of conicity greater than or equal to zero and less than the first angle of conicity, wherein the stamping body has a slightly smaller size than an opening region of the mould, and wherein when the stamping body is completely located in the mould, at least a portion of a height of said stamping body has a clearance with respect to the material web, at least in a lateral edge region of the container.

2. A device according to claim 1, wherein the first angle of conicity is 1 degree to 20 degrees, and wherein the stamping body is cylindrical in a region forming a container wall or the second angle of conicity is less than a third angle of conicity of the container wall.

3. A device according to claim 2, wherein the stamping body has at least two regions, of which a first region is the region forming the container wall and a second region is the region in which the portion of the height of the stamping body has the clearance with respect to the material web.

4. A device according to claim 3, wherein the second region has a fourth angle of conicity between 0 degrees and 8 degrees.

5. A device according to claim 1, wherein the stamping body is comprised of natural rubber, an acrylonitrile-butadiene rubber or a urethane rubber.

6. A device according to claim 5, wherein the stamping body has a hardness of 50 ShA to 130 ShA.

7. A device according to claim 5, wherein the stamping body further contains at least one fluorine-containing additive for improving a sliding property.

8. A device according to claim 7, wherein the stamping body additionally comprises at least one of a filler or a material for reinforcement.

9. A device according to claim 1, wherein the stamping body is vulcanised on a carrier element comprised of metal.

10. A device according to claim 1, wherein the stamping body is annular and operatively connects with an insert comprised of metal, which is connected to a carrier element comprised of metal.

11. A device according to claim 10, wherein an annular clearance is configured between the insert and the stamping body.

12. A device according to claim 10, wherein the insert on a side opposing the carrier element is configured as an embossed plate with a structure, which forms a base region of the container.

13. A device for forming a deep-drawn container, comprising a mould, which has a conical shape having a first angle of conicity and interacts with a stamping body, the stamping body comprising a first region which operatively connects with a material web when the stamping body enters the mould, the stamping body further comprising a resilient material, at least at an outer periphery of the stamping body, wherein the first region includes a lateral surface having a second angle of conicity greater than or equal to zero and less than the first angle of conicity, wherein the stamping body has a slightly smaller size than an opening region of the mould, wherein when the stamping body is completely located in the mould, said stamping body has a clearance with respect to the material web, at least in a lateral edge region of the container, and wherein the stamping body has a second region having a cross sectional area smaller than a cross sectional area of the first region which operatively connects with the material web, and wherein the first region operatively connecting with the material web has a height of at least 5 mm.

14. A method of forming a container comprising providing a device in accordance with claim 1, positioning a material web over the opening region of the mould, and inserting the stamping body into the mould such that the stamping body operatively connects with the material web.

15. A method according to claim 14, wherein an external diameter of the container is between 12 mm and 150 mm.

16. A method according to claim 14, wherein the container has a substantially polygonal external shape.

17. A method according to claim 16 wherein the container includes corners having an external radius of 2 mm to 40 mm.

18. A method according to claim 16, wherein the material web is at least partially comprised of aluminium or steel, and wherein the material web is a laminated material web using one or more aluminium or steel layers and one or more plastics material layers as the laminate layers and a thickness of the aluminium or steel layer(s) is between 20 μm and 200 μm.

19. A method according to claim 14, wherein the material web is at least partially comprised of aluminium or steel, and wherein the material web is a laminated material web using one or more aluminum or steel layers and one or more plastics material layers as the laminate layers and a thickness of the aluminium or steel layer(s) is between 20 μm and 200 μm.

* * * * *